US005656891A

United States Patent [19]

Luger et al.

[11] Patent Number: 5,656,891

[45] Date of Patent: Aug. 12, 1997

[54] GAS DISCHARGE LAMP BALLAST WITH HEATING CONTROL CIRCUIT AND METHOD OF OPERATING SAME

[75] Inventors: Siegfried Luger, Dornbirn; Thomas Marinelli, Wolfurt, both of Austria

[73] Assignee: Tridonic Bauelemente GmbH, Dornbirn, Austria

[21] Appl. No.: 530,710

[22] Filed: Sep. 19, 1995

[30] Foreign Application Priority Data

Oct. 13, 1994 [DE] Germany ..... 44 36 705.8
Jan. 20, 1995 [DE] Germany ..... 195 01 695.5

[51] Int. Cl.[6] ..... H05B 41/36

[52] U.S. Cl. ..... 315/94; 315/105; 315/107; 315/225

[58] Field of Search ..... 315/94, 105, 106, 315/107, 225, 291, 307, 309, DIG. 5

[56] References Cited

U.S. PATENT DOCUMENTS 4,988,920 1/1991 Hoeksma ..... 315/101
5,027,033 6/1991 Zuchtriegel ..... 315/106
5,122,712 6/1992 Hirschmann ..... 315/106
5,130,605 7/1992 Ogawa et al. ..... 315/105

FOREIGN PATENT DOCUMENTS

0589081A1 3/1994 European Pat. Off. .
0594880A1 5/1994 European Pat. Off. .

*Primary Examiner*—Robert Pascal
*Assistant Examiner*—David Vu
*Attorney, Agent, or Firm*—Fitzpatrick, Cella, Harper & Scinto

[57] ABSTRACT

There is provided a ballast for at least one gas discharge lamp having an inverter which has two switches (S1, S2) in series, connected to a d.c. voltage source and switched with complementary timings, and a load circuit connected in parallel with one of the two switches (S1, S2) which load circuit includes a series resonant circuit (L1, C1) and the lamp (LA). Additionally there is provided a heating circuit (T, S3,R1) for current supply of the lamp coils, likewise connected to the inverter, which heating circuit includes a further periodically switchable switch (S3) for control of the heating current, whereby the heating circuit is likewise connected in parallel to one of the two switches of the inverter.

16 Claims, 5 Drawing Sheets

GAS DISCHARGE LAMP BALLAST WITH HEATING CONTROL CIRCUIT AND METHOD OF OPERATING SAME

BACKGROUND OF THE INVENTION

1. Field of the Invention

This invention relates to a ballast for at least one gas discharge lamp, and to a method of operating a gas discharge lamp having such a ballast.

2. Description of the Related Art

Today, with high quality ballasts for gas discharge lamps, the lamp electrodes are usually preheated before the ignition voltage is applied therebetween. It has been found that through this measure the lamp life is extended to a considerable degree.

As is described for example in EP 0 594 880 A1, gas discharge lamps are as a rule operated on a series oscillation circuit, whereby an oscillation circuit capacitor lies, as a rule in parallel to the discharge path of the gas discharge lamp. The electrodes of the lamp are formed as heating coils through which the current of the oscillation circuit flows when the lamp is not ignited. In a preheating operation, the frequency is so varied with respect to the resonance frequency of the resonant circuit that the voltage applied across the resonance capacitor and thus across the gas discharge lamp does not cause ignition of the gas discharge lamp. In this way, there flows a substantially constant current through the lamp electrodes configured as coils, so that these are preheated. After conclusion of the preheating phase, the frequency is set in the region of the resonance frequency of the resonant circuit, by means of which the voltage across the resonance capacitor so increases that the gas discharge lamp ignites.

It is usual today, with high quality ballasts, to provide also for dimming operation of the gas discharge lamp. It has now been found that with strong dimming a premature aging of the gas discharge lamp occurs. For this reason it is necessary to provide an arrangement with which the electrodes of the gas discharge lamp can be heated also in ignited operation. In particular it is advantageous to set the heating of the electrodes in dependence upon the degree of dimming, i.e. the more strongly the lamp is dimmed that is, the darker it is—the more strongly must the electrodes be heated.

A suitable circuitry arrangement for this purpose is described in EP 0 589 081 A1. This has the primary winding of a heating transformer in the resonant circuit, the secondary windings of which are connected in parallel to the terminals of the heating coils. In this way it is possible also in ignited operation to supply energy to the heating coils. Further, there is provided a controllable switch in parallel to the primary winding of the heating transformer, which switch bridges the primary winding when needed and thus simultaneously prevents the heating of the heating coils.

This arrangement has, however, the disadvantage that through the provision of the primary winding of the heating transformer in the series resonant circuit this damps the resonant circuit at least so long as heating of the coils is necessary, i.e. the switch connected parallel to the primary winding is open. This leads to a detuning of the resonant circuit, so that reliable ignition and thus dependable operation can no longer be unrestrictedly ensured.

SUMMARY OF THE INVENTION

Thus, an object of the invention is to provide a ballast for at least one gas discharge lamp such that a dependable operation, protective of the lamp, is always ensured.

This object is achieved in accordance with one aspect of the present invention in that an inverter has two switches, connected to a d.c. voltage source and switched in complementary timing, which lie in series, there being connected to the inverter a load circuit consisting of a series resonant circuit and the lamp and a heating circuit for current supply of the lamp coils. The heating circuit has, moreover, a further controllable switch for controlling the heating current. Furthermore, the heating circuit is likewise connected in parallel to one of the two switches of the inverter.

According to a further aspect of this invention, upon preheating of the gas discharge lamp the inverter is operated with maximum timing frequency, whilst the timing for the additional controllable switch is so selected that the gas discharge lamp is operated with the maximum permissable heating power.

With the circuitry arrangement in accordance with the invention it is ensured that the series resonant circuit can work uninfluenced and thus undamped. Further, it is made possible by means of the method in accordance with the invention, in dependence upon the degree of dimming of the gas discharge lamp determined by way of the inverter, to set the respective necessary heating voltage. Additionally, it is possible with the employment of differing lamps on one and the same ballast to make available the necessary heating power for the respectively selected lamp without thereby affecting the operational conditions of the lamp.

Further advantageous configurations of the invention are described in detailed in the following specification.

It is thus advantageous, in particular for the energy economy of the ballast in accordance with the invention, that the further switch is so switched that the lamp is only supplied with heating current when it must be heated because of its operational condition. Thus, only so much energy as is unavoidably necessary for the heating of the lamp is consumed.

In accordance with further features of the invention there are provided advantageous configurations of the ballast.

In accordance with a still further feature of the invention, configurations are provided which ensure that the control of the additional switch, taking into consideration the control of the inverter, is kept as simple as possible and at the same time variable in order to be able to set the necessary heating power as exactly as possible.

In accordance with other features of the invention there are provided configurations of the heating circuit which employ the advantageous use of a heating transformer and likewise provide for a circuitry configuration which is as simple as possible and reliable.

According to yet another feature of the invention operation of the gas discharge lamp within a permitted operational range for the heating power is ensured.

BRIEF DESCRIPTION OF THE DRAWINGS

The invention will be described in more detail with reference to exemplary embodiments and with reference to the drawings, In these drawing.

DETAILED DESCRIPTION OF THE PREFERRED EMBODIMENT

Figure 1:
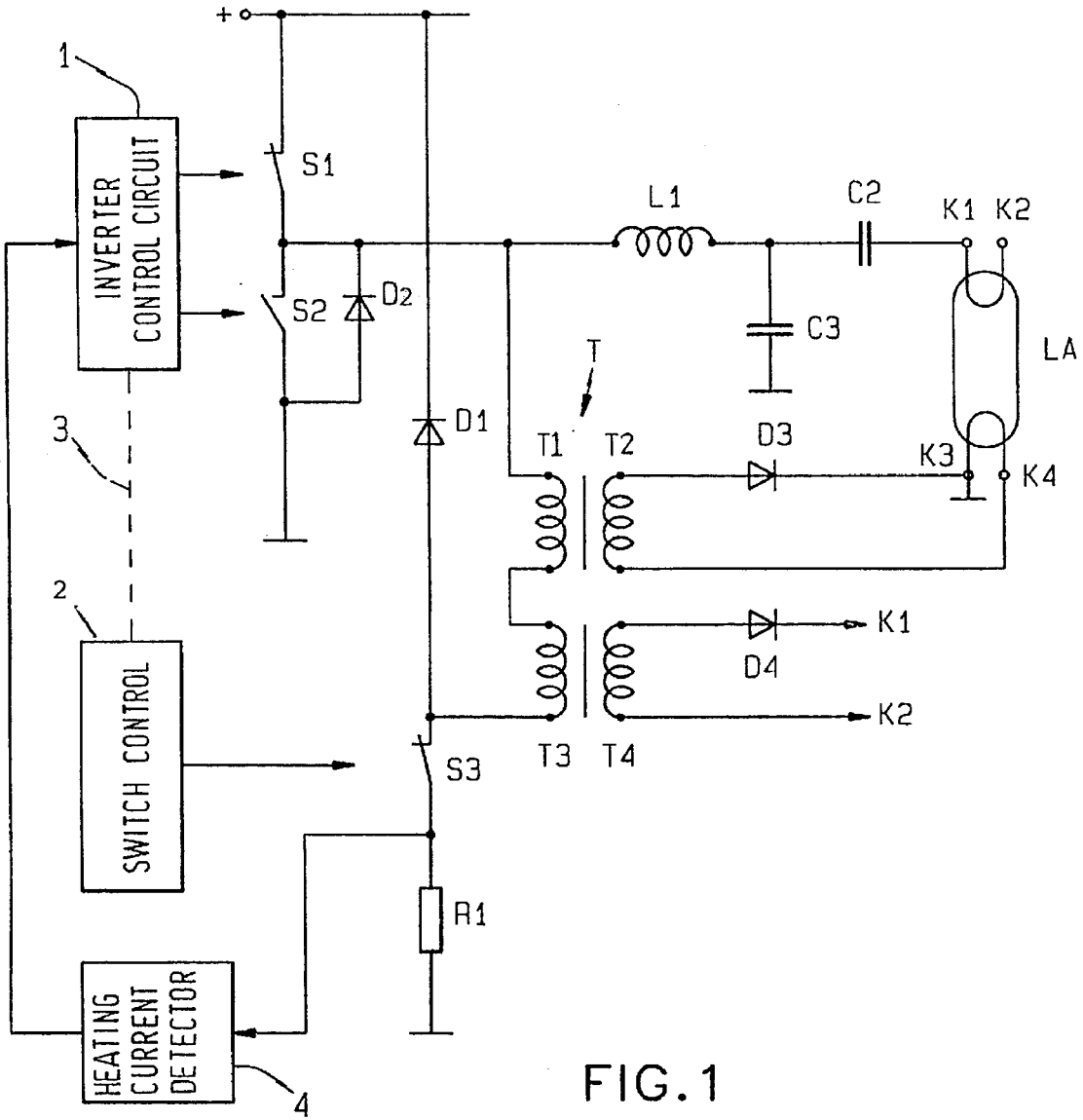
FIG. 1 is a circuit and block diagram of an exemplary embodiment of an electronic ballast according to the present invention.

In FIG. 1 the main parts of a exemplary embodiment of a ballast for a gas discharge lamp are represented. This has first an inverter comprising the controllable switches S1 and S2 which are controlled in complementary timing by means of an inverter control circuit 1. Thus, alternately, one switch is on and the other off. The two inverter switches S1 and S2 are connected in series between a positive supply voltage and ground. The common node of the two inverter switches S1, S2 is connected to a load circuit which comprises a series resonant circuit made of a resonance circuit coil L1 and a resonance circuit capacitor C3. The resonance circuit capacitor C3 is connected to ground with one of its terminals. At a connection node between the resonance circuit capacitor C3 and the resonance circuit coil L1, one terminal of a coupling capacitor C2 is connected. The other terminal of the coupling capacitor C2 is connected with one of two cathodes of a gas discharge lamp LA. The two cathodes of the gas discharge lamp LA each have two terminals between which, in each case, there is provided a heating coil for the heating of the cathode concerned. The electrode of the gas discharge lamp LA which is not connected to the coupling capacitor C2 is connected to ground with a terminal K3.

Further, a heating transformer T is provided which has two primary-side windings T1 and T3 and two secondary-side windings T2 and T4. One primary-side winding T1 is connected with one of its terminals to the connection node of the two inverter switches S1 and S2 and with its second terminal connected to the second primary-side winding T3. This is in turn connected with one terminal of a further controllable switch S3. The second terminal of the further controllable switch S3 is in turn connected with a resistance R1 which is connected to ground at the other end. Thus there is provided a series circuit of the two primary-side windings of the heating transformer, the further controllable switch S3 and the resistance R1, which are connected in parallel to the inverter switch S2.

The further controllable switch S3 is operated by a switch control 2 associated therewith.

The two secondary-side windings T2 and T4 of the heating transformer T are each connected with a respective one of the two electrodes of the gas discharge lamp LA via series circuits having respective diodes D3 and D4. Thus, the winding T2 is connected via the diode D3 with the heating coil terminals K3 and K4 of the one electrode and the winding T4 is connected via the diode D4 with the heating coil terminals K1 and K2 of the second electrode.

Finally, there is connected to the connection node between the further switch S3 and the secondary winding T3, by means of its anode, a diode D1 the cathode of which is connected with the positive supply voltage. Finally, a diode is connected parallel to the inverter switch S2 the anode terminal of which is connected to ground. This diode can be omitted when FET transistors are employed, insofar as the transistors employed already have a diode circuit integrated therein.

Below there will be described an advantageous operation of the above-described circuitry arrangement with reference to FIGS. 1 and 2.

Figure 2:
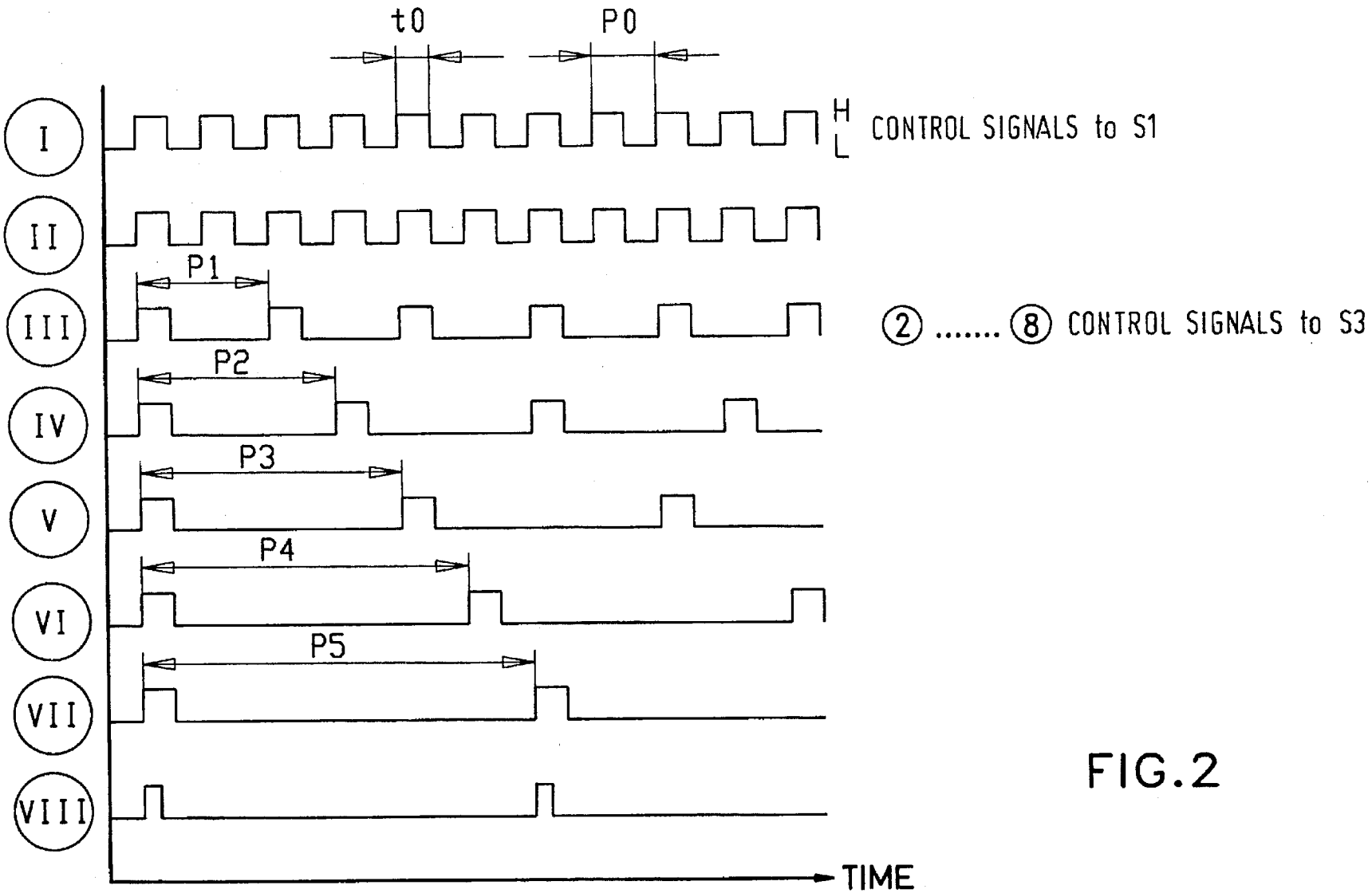
FIG. 2 control signals which are produced upon operation of switches in the embodiment of FIG. 1.

In FIG. 2, control signals for the inverter switch S1 are represented in curve I, which signals alternate periodically between levels L and H. The period length is P0, whereby the signal is at the level H for the duration to. It will now be assumed that the inverter switch S1 is closed so long as it is controlled with the level H. At the same time, as already explained above, the second inverter switch S2 switches alternately to the switch S1.

For the sake of completeness it is to be mentioned that in the connected series resonant circuit there is provided an oscillation having the period of the control signals to the inverter switches, whereby when the period P0 is in the vicinity of the resonance frequency of the series resonant circuit, the gas discharge lamp LA ignites.

By means of an increase of the switching frequency of the inverter above the resonance frequency of the resonant circuit there is effected a dimming of the lamp, i.e. the more strongly the period P0 deviates from the resonance frequency of the series resonant circuit the more strongly is the lamp dimmed, i.e. the darker it is. Such operation alone would have, as already explained above, the consequence that the lamp would be subjected to increased aging.

Therefore, there is provided a coupling of the control circuit 2 of the further controlled switch S3, via a coupling 3, with the inverter control circuit 1. This is effected in accordance with FIG. 3 in the manner that the further controllable switch S3 is only switched on when the inverter switch S1 is also switched on. This corresponds to the synchronization of the control signals in accordance with curve I and the control signals for the switch S3 in accordance with curves II to VIII.

Curves I and II are identical, so that the switches S1 and S3 switch with the same timing and are thereby simultaneously switched on or off. From this there is provided that when the switch S1 is switched on there simultaneously flows a primary-side current through the windings T1 and T3 of the heating transformer T via the connected further controllable switched S3 and the resistance R1 from the positive supply voltage terminal to ground. Since, in accordance with curve II in FIG. 2, this involves an interrupted current, i.e. not d.c. current, in accordance with the laws of magnetic induction there is induced, with the same timing, a voltage on the secondary side of the heating transformer, i.e. in the windings T2 and T4, which results in a current that, as described, flow through the connected heating coils and thus leads to a heating of the electrodes of the gas discharge lamp LA. As soon as the further controllable switch S3 is opened, the current flow through the windings T1 and T3 is interrupted so that, as a result of the known physical laws, an abrupt voltage increase occurs at the connection node between the switch S3 and the winding T3. This voltage increase is limited by means of the diode D1 to the value of the positive supply voltage. In the switching phases in which the switch S3 is open there is thus provided through the discharge of the energy stored in the heating transformer a demagnetization. The diodes D3 and D4 are also necessary for the demagnetization of the heating transformer T.

As already explained above, the gas discharge lamp LA can in the end be dimmed by means of alteration of the timing frequency of the inverter. In order, however, not to unnecessarily reduce the life of the gas discharge lamp it is necessary here, in correspondence to the degree of dimming, to match the heating power of the electrode heating. In accordance with curves II to VII in FIG. 2 this can be effected in that the further controlled switch S3 is not also switched on with each switching on of the inverter switch S1. Rather, longer timing periods P1 to P5 for example can be provided whereby the periods P1 to P5 are whole multiples of the timing period of the inverter switch S1.

In other words, with undimmed or weakly dimmed operation of the lamp, no or only small heating power is necessary, so that for the further controlled switched S3 for example a switching period P5 in accordance with curve VII may be provided. Additionally there exists the possibility that in undimmed operation the heat generation of the electrodes is so great that no additional heating of the electrodes is necessary. In this case, the further controllable switch S3 remains open, so that no energy is consumed for additional heating power, whereby the arrangement works with the greatest possible efficiency. Thus, a provision of heating power is necessary only when, as a result of the dimming, the self heat generation is not sufficient.

In line with a stronger dimming of the gas discharge lamp LA, for the purpose of providing a higher heating power, i.e. a more frequently returning heating current, the timing period at the further switch S3 must be reduced, until it attains a maximum heating power at the highest degree of dimming. This corresponds to curve II, with which, as already explained above, the switches S3 and S1 work with these same timing.

A further alternative and also additionally applicable possibility for setting the heating power consists in varying the switching duration for which the switch S3 is switched on. While in the curves II to VII the switch S3 is switched on for exactly as long as the switch S1, and only the time for which the switch S3 is switched off is varied, in accordance with curve VIII the switch S3 is switched on markedly more briefly. This simultaneously reduces the attainable heating current through the heating coil.

Figure 4:
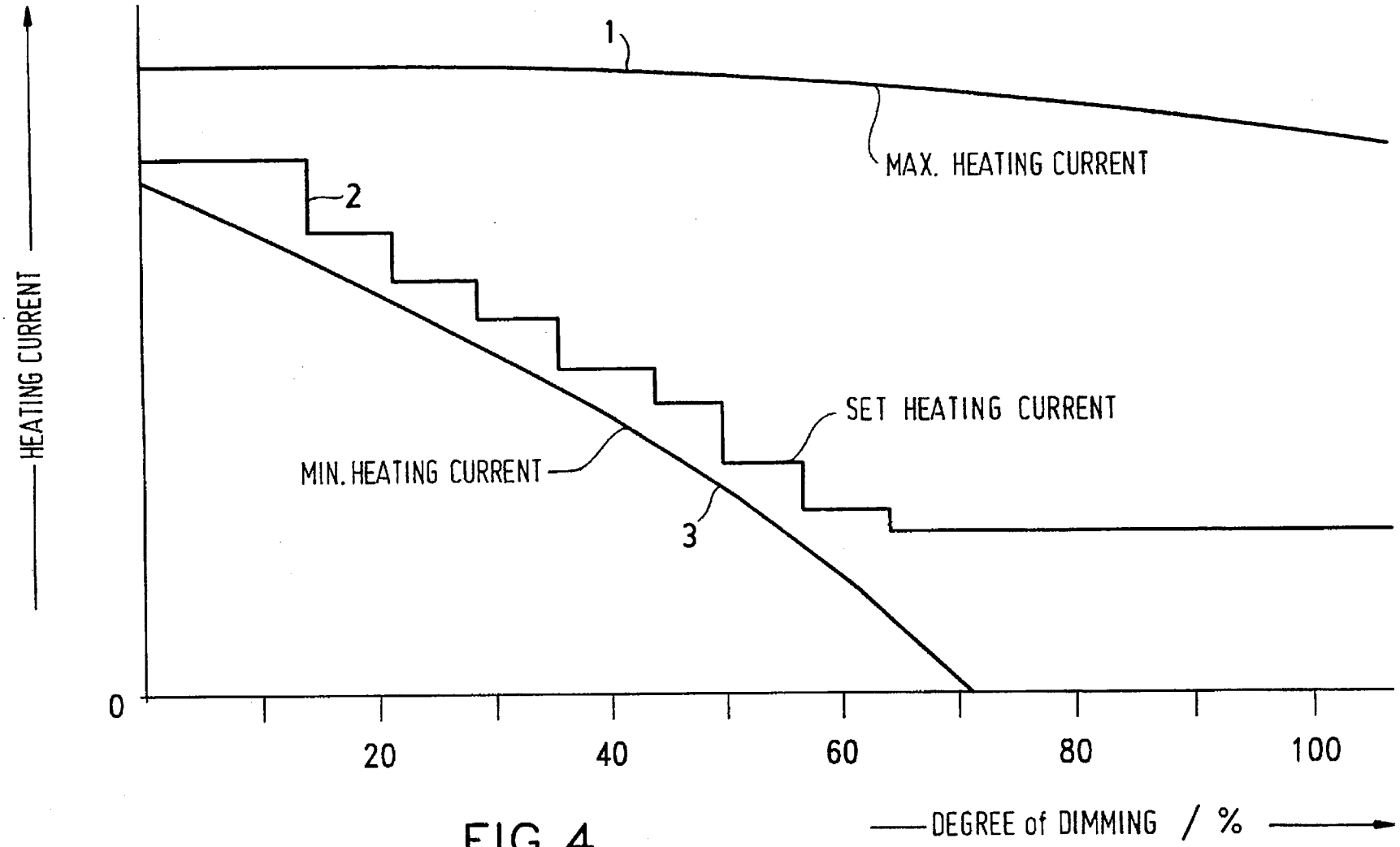
FIG. 4 is a graph showing the relationship between a settable heating current and a degree of dimming in the embodiment of FIG. 1

In the representation according to FIG. 4, in curves 1 and 3, the maximum and minimum heating currents, recommended by the manufacturer of a gas discharge lamp, are represented in dependence upon the degree of dimming.

Curve 2 represents the heating current attainable with the above described circuitry and manner of control. It is thus clear from FIG. 4 that a heating current for a gas discharge lamp which is just above the minimum necessary heating current is well attainable.

Figure 5:
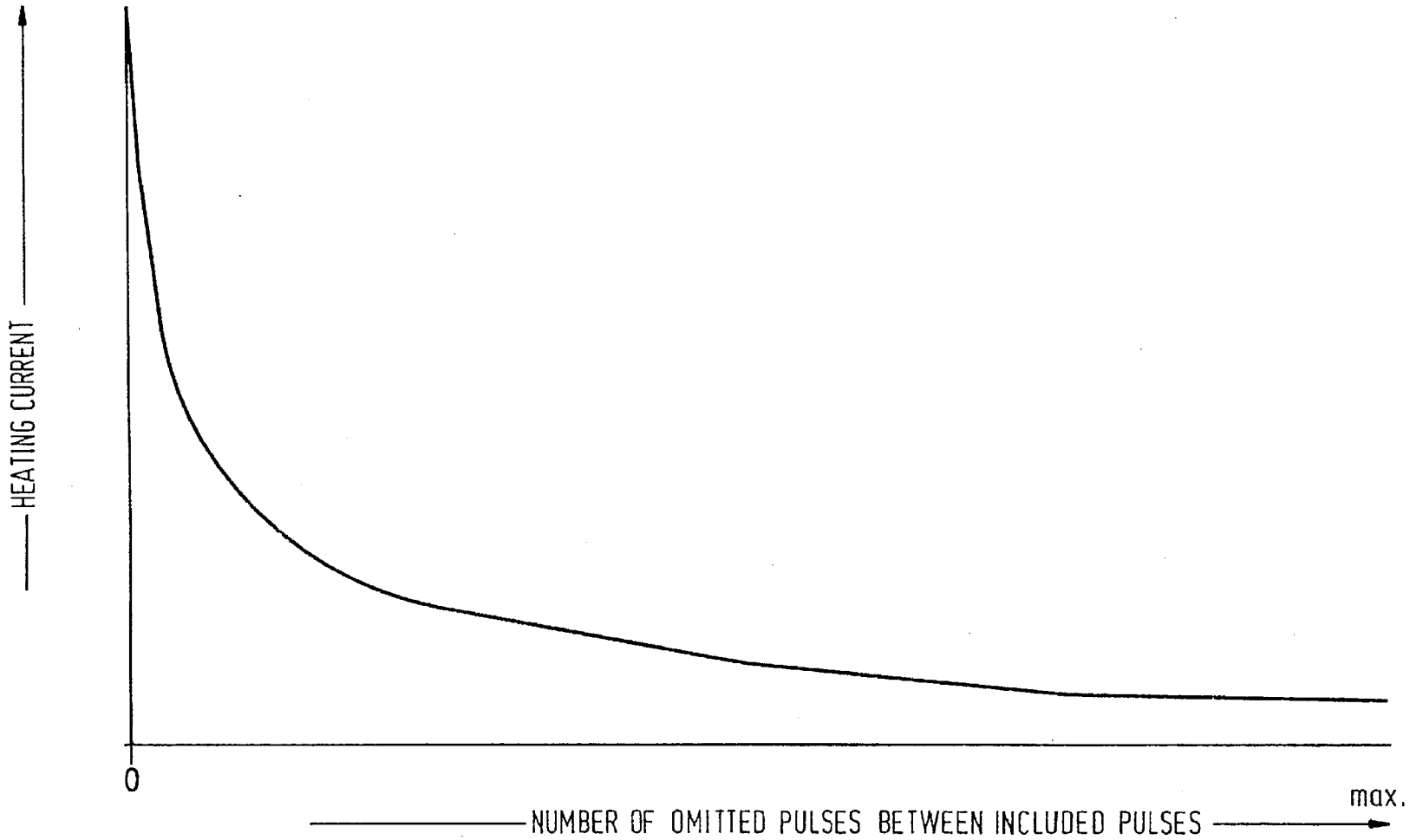
FIG. 5 is a graph showing the relationship between the effective heating current and a pulse count in the embodiment of FIG. 1

There is shown in FIG. 5 a representation which indicates the heating current which can be set, in dependence upon the number of turn-on pulses which are omitted in comparison with the switch S1, i.e. which represents the correspondingly whole-multiple extended periodic duration. When the number of omitted turn-on pulses is equal to 0—as in II of FIG. 2—a maximum heating current is attainable. This value can be reduced virtually continuously.

Figure 6:
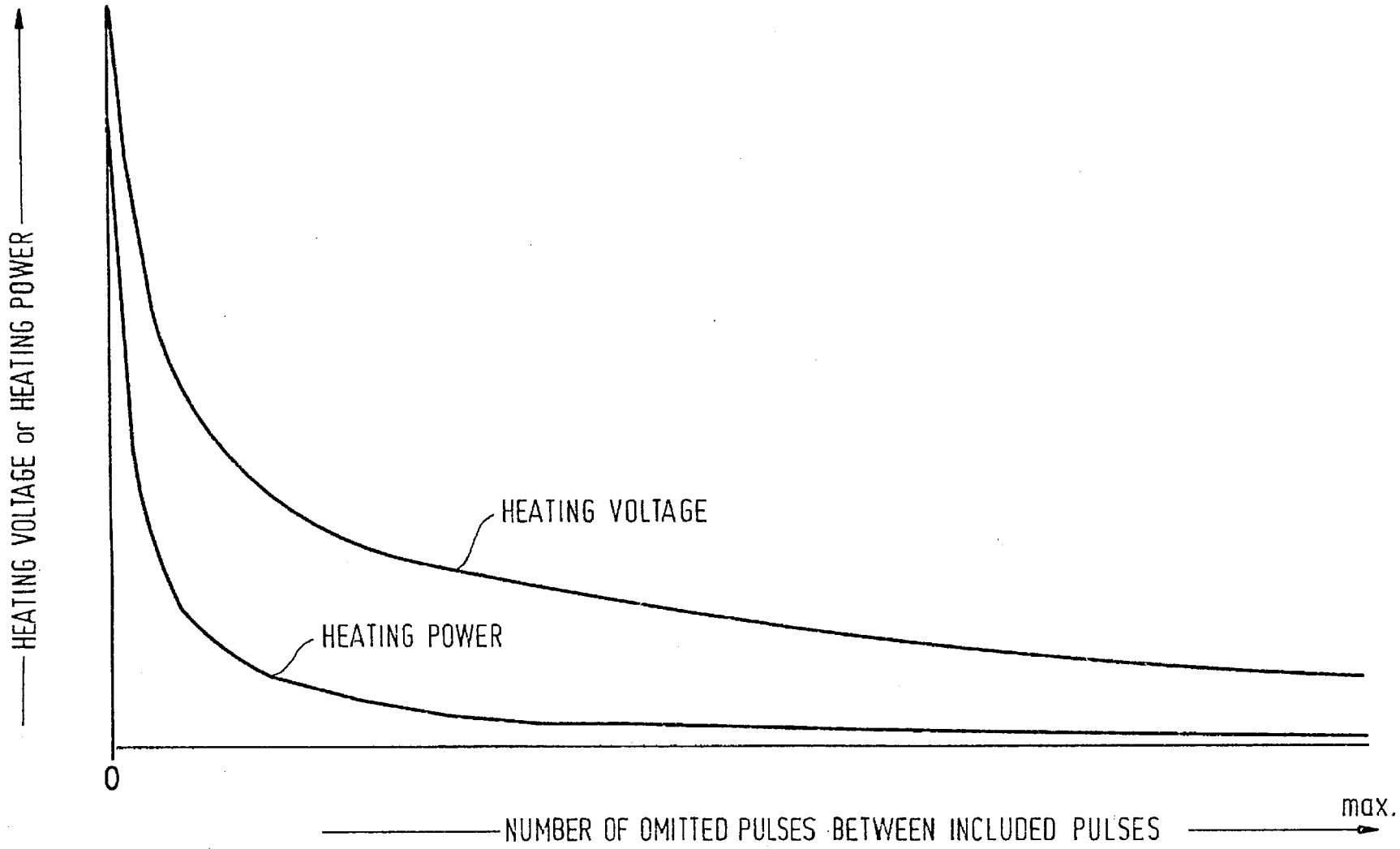
FIG. 6 is a graph showing the relationship of the heating voltage or heating power and the the pulse count in the embodiment of FIG. 1.

Further, in accordance with FIG. 6, there is yielded the maximum heating voltage whereby with this voltage, as also indicated in FIG. 6, a maximum heating power can be attained. In correspondence with the continuous variability of heating current and heating voltage a continuous variation of the heating power is, as indicated, consequently settable.

This shows that with simple means the heating power can be set substantially independently of the operation of the gas discharge lamp. This provides that the above explained circuitry is applicable not only for adaptation of the degree of dimming but also for the adaptation of the heating power, upon use of different lamps, to the requirements of those lamps both upon preheating and also in dimming operation.

Figure 3:
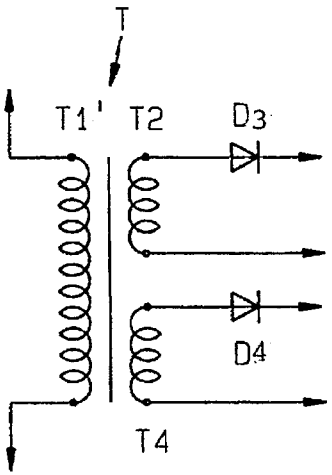
FIG. 3 is a circuit diagram showing a variant of a heating transformer provided in the embodiment FIG. 1.

In accordance with FIG. 3, a circuit variant of the heating transformer T is represented. Here, on the primary side, there are provided not two series-connected windings but a single winding wound around a core, which drives the secondary side windings T2 and T4.

The above described circuitry arrangements are primarily pure control means with which the dependence between the switching frequency P0 of the inverter and the switching frequency of the further controllable switch S3 is determined. Naturally, a regulation means can just as well be conceived. In such a case, the lamp current is measured in per se known manner and supplied (not shown) to the control circuits 1 and 2. Additionally, a voltage proportional to the heating current can be measured at the resistance R1 and the value of the heating current supplied as a signal to the inverter control circuitry by way of a heating current detector 4. In this manner the heating current can be set directly in dependence upon the lamp current by means of regulation.

This arrangement has further the advantage that it can also be detected when a coil break has occurred, thus that the lamp is defective, and when the lamp is removed from the arrangement. Through this detection via the heating current detector 4 and passing on of the information to the inverter control circuitry 1, the lamp voltage can be directly reduced by means of variation of the inverter frequency. Likewise, it is detected when the lamp LA is put back in place, so that the inverter can be so operated that the lamp LA is automatically ignited after being put in place.

We claim:

1. Ballast for at least one gas discharge lamp having an inverter which has two switches connected in series with a d.c. voltage source and switched with complimentary timings, a load circuit connected to the inverter, which load circuit includes a series resonant circuit and a lamp having heating coils, said load circuit being connected in parallel with one of said two switches of said inverter, and a heating circuit for current supply to the lamp heating coils, said heating circuit likewise being connected to the inverter, said heating circuit including a further controllable switch for control of the heating current, the heating circuit being connected in parallel with one of the two switches of the inverter, characterized in that, said further controllable switch is so connected that said lamp is supplied with heating current only when said one inverter switch, with which the load circuit is connected in parallel, is open.

2. Ballast according to claim 1, further characterized in that, an impedance is connected in series with the further controllable switch, whereby the voltage drop across this impedance is employed as a detection signal for a flow of heating current and thus for heating coil breakage or a defect of the lamp.

3. Ballast according to claim 2, further characterized in that, said impedance is connected such that the voltage drop thereacross is employed as a detection signal for the replacement of said lamp.

4. Ballast according to claim 2 further characterized in that said impedance is an ohmic resistance.

5. Ballast for at least one gas discharge lamp having an inverter which has two switches connected in series with a d.c. voltage source and switched with complimentary timings, a load circuit connected to the inverter, which load circuit includes a series resonant circuit and a lamp having heating coils, said load circuit being connected in parallel with one of said two switches of said inverter, and a heating circuit for current supply to the lamp heating coils, said heating circuit likewise being connected to the inverter, said heating circuit including a further controllable switch for control of the heating current, the heating circuit being connected in parallel with one of the two switches of the inverter, characterized in that, the switching period of the further controllable switch is variable by a whole number multiple of the timing period of the inverter.

6. Ballast for at least one gas discharge lamp having an inverter which has two switches connected in series with a d.c. voltage source and switched with complimentary timings, a load circuit connected to the inverter, which load circuit includes a series resonant circuit and a lamp having heating coils, said load circuit being connected in parallel with one of said two switches of said inverter, and a heating circuit for current supply to the lamp heating coils, said heating circuit likewise being connected to the inverter, said heating circuit including a further controllable switch for control of the heating current, the heating circuit being connected in parallel with one of the two switches of the inverter, characterized in that, the length of time over which the further controllable switch supplies the heating device with heating current is shorter than the length of time for which the inverter switch with which the load circuit lies in parallel, is open.

7. Ballast according to claim 6, further characterized in that, the length of time for which the further controllable switch supplies the heating circuit with current is settable.

8. Ballast according to claim 7, further characterized in that, the setting of at least one of the time range and the switching period is dependent upon the current in the load circuit.

9. Ballast for at least one gas discharge lamp having an inverter which has two switches connected in series with a d.c. voltage source and switched with complimentary timings, a load circuit connected to the inverter, which load circuit includes a series resonant circuit and a lamp having heating coils, said load circuit being connected in parallel with one of said switches of said inverter, and a heating circuit for current supply to the lamp heating coils, said heating circuit likewise being connected to the inverter, said heating circuit including a further controllable switch for control of the heating current, the heating circuit being connected in parallel with one of the two switches of the inverter, characterized in that, said heating circuit has a heating transformer wherein the primary side of which is connected in parallel with one of the two inverter switches and the secondary side of which is connected with the lamp coils.

10. Ballast according to claim 9, further characterized in that, the heating transformer has individual secondary-side windings connected, respectively, to each lamp heating coil and has, on its primary side, at least one common winding which corresponds to said secondary side windings.

11. Ballast according to claim 10 further characterized in that, the heating transformer has two primary windings connected in series with one another and which correspond, respectively, to said secondary windings.

12. Ballast according to claim 9, further characterized in that, the further controllable switch is connected in series with the primary side of the heating transformer.

13. Ballast according to claim 9, further characterized in that, there is provided a circuitry arrangement for the demagnetization of the heating transformer, which demagnetizes the heating transformer when said heating transformer supplies no heating current to the lamp coil.

14. Method of operating a ballast for at least one gas discharge lamp having an inverter which has two switches connected in series with a d.c. voltage source and switched with complimentary timings, a load circuit connected to the inverter, which load circuit includes a series resonant circuit and a lamp having heating coils, said load circuit being connected in parallel with one of said two switches of said inverter, and a heating circuit for current supply to the lamp heating coils, said heating circuit likewise being connected to the inverter, said heating circuit including a further controllable switch for control of the heating current, the heating circuit being connected in parallel with one of the two switches of the inverter, said further controllable switch being so connected that said lamp is supplied with heating current only when said one inverter switch, with which the load circuit is connected in parallel is open, characterized in that, after ignition of the lamp, its heating is discontinued upon operation of said further controllable switch, at least until a requirement for further heating arises.

15. Method of operating a gas discharge lamp having a ballast, said ballast having an inverter which has two switches connected in series with a d.c. voltage source and switched with complimentary timings, a load circuit connected to the inverter, which load circuit includes a series resonant circuit and a lamp having heating coils, said load circuit being connected in parallel with one of said two switches of said inverter, and a heating circuit for current supply to the lamp heating coils, said heating circuit likewise being connected to the inverter, said heating circuit including a further controllable switch for control of the heating current, the heating circuit being connected in parallel with one of the two switches of the inverter, said further controllable switch being so connected that said lamp is supplied with heating current only when said one inverter switch, with which the load circuit is connected in parallel, is open, characterized in that, upon preheating of the lamp electrodes, the switches of the inverter are operated with maximum timing frequency and for igniting the gas discharge lamp the timing frequency is reduced down to the vicinity of the resonance frequency of the series resonant circuit, and further characterized in that, upon preheating of the lamp electrodes, the further controllable switch is operated with a timing frequency which makes possible heating with maximum permitted heating power.

16. Method according to claim 15, characterized in that, after ignition of the gas discharge lamp, the timing frequency of the further controllable switch is set in dependence upon a dimming condition of the gas discharge lamp, so that the heating power lies between the maximum heating power permitted for the gas discharge lamp and the minimum necessary heating power.

* * * * *